US011008748B1

(12) United States Patent
Hodge, Jr.

(10) Patent No.: US 11,008,748 B1
(45) Date of Patent: May 18, 2021

(54) APPARATUSES AND METHODS FOR A STORM DRAIN GRATE GUARD

(71) Applicant: Great Guard, LLC, Clarksburg, WV (US)

(72) Inventor: Timothy W. Hodge, Jr., Clarksburg, WV (US)

(73) Assignee: Great Guard, LLC, Clarksburg, WV (US)

( * ) Notice: Subject to any disclaimer, the term of this patent is extended or adjusted under 35 U.S.C. 154(b) by 0 days.

(21) Appl. No.: 16/786,516

(22) Filed: Feb. 10, 2020

Related U.S. Application Data

(60) Provisional application No. 62/804,264, filed on Feb. 12, 2019.

(51) Int. Cl.
*E03F 5/06* (2006.01)
*E03F 5/14* (2006.01)
*E03F 5/04* (2006.01)

(52) U.S. Cl.
CPC ..... *E03F 5/14* (2013.01); *E03F 5/0404* (2013.01); *E03F 5/06* (2013.01)

(58) Field of Classification Search
CPC . E03F 5/0404; E03F 5/041; E03F 5/05; E03F 5/14; E03F 7/06; E03F 5/06
USPC ..... 210/163, 166, 170.03, 747.3; 404/2, 4
See application file for complete search history.

(56) References Cited

U.S. PATENT DOCUMENTS 550,032 A * 11/1895 Tucker ..... E03F 5/0404 210/163
1,674,347 A 6/1928 Silverman
1,791,512 A 2/1931 Schurman
1,862,134 A 6/1932 Boosey
1,999,277 A 4/1935 Boosey
D101,978 S 11/1936 Williams
3,392,844 A 7/1968 Decarie
4,035,297 A 7/1977 Aldridge et al.
4,525,273 A 6/1985 Logsdon
(Continued)

FOREIGN PATENT DOCUMENTS

DE 19951935 * 5/2001

OTHER PUBLICATIONS

"Bar Guards" Manufactured by Agri Drain Corporation, www.agridrain.com, 1 pg.

*Primary Examiner* — Christopher Upton
(74) *Attorney, Agent, or Firm* — Dinsmore & Shohl LLP

(57) ABSTRACT

Apparatus and methods for a storm drain grate guard are provided. An apparatus may include an annular apex support member, an apex member affixed to the apex support member, and an annular intermediate support member having a circumference larger than the apex support member. The apparatus may further include a first portion forming a conical frustum between the apex support member and the intermediate support. The apparatus may additionally include an annular base support member having a circumference equal to or larger than the intermediate support. The apparatus may still further include a second portion between the intermediate support member and the base support member. The apparatus may also further include at least three vertical members each peripherally connected to the apex support member, the first portion, the intermediate support member, the second portion, and base support member such that the vertical members surround a longitudinal axis.

3 Claims, 6 Drawing Sheets

(56) References Cited

U.S. PATENT DOCUMENTS 4,658,449 A * 4/1987 Martin ..... E04H 4/1236 210/163
4,685,449 A 8/1987 Bonnet
5,234,582 A 8/1993 Savoie
5,469,670 A 11/1995 Thaler
5,480,254 A * 1/1996 Autry ..... E03F 5/0404 210/163
5,618,416 A 4/1997 Haefner
5,689,928 A 11/1997 Rasksen
5,735,091 A 4/1998 Hawkins et al.
5,744,048 A 4/1998 Stetler
5,843,306 A 12/1998 Singleton
5,966,884 A 10/1999 Uglow
6,006,457 A 12/1999 Transport
6,165,357 A 12/2000 Cormier
6,193,880 B1 * 2/2001 Bergeron ..... E04D 13/0409 210/163
6,261,445 B1 7/2001 Singleton
6,416,674 B1 7/2002 Singleton
6,428,693 B2 8/2002 Singleton
6,447,206 B1 * 9/2002 Fleury ..... E03F 7/06 210/162
6,588,029 B2 7/2003 Mullings
6,631,588 B1 10/2003 Distler
7,300,573 B1 11/2007 Trangsrud
7,407,574 B2 8/2008 Robinson
7,854,838 B2 12/2010 Martin
8,557,109 B1 10/2013 Sutherland
8,834,714 B2 9/2014 Chien
9,334,618 B1 * 5/2016 Dodd ..... E03F 5/0404
9,422,693 B2 8/2016 Johnston et al.
9,719,240 B1 * 8/2017 Montague ..... E03F 5/0404
2007/0205144 A1 9/2007 Robinson
2008/0251470 A1 10/2008 Kent
2010/0025312 A1 2/2010 Martin
2012/0222996 A1 9/2012 Rennels

* cited by examiner

APPARATUSES AND METHODS FOR A STORM DRAIN GRATE GUARD

CROSS-REFERENCE TO RELATED APPLICATIONS

This application claims the benefit of U.S. Provisional Application 62/804,264 filed Feb. 12, 2019, which is incorporated by reference in its entirety.

TECHNICAL FIELD

The present application generally relates to drainage flow, such as water drainage into storm drain grates.

BACKGROUND

One of the major issues on commercial and residential developments is keeping storm drain grates clear during rain events. A significant challenge is keeping storm water runoff from a construction site directed toward the storm water drop inlets engineered to receive it, and keeping the grates on those storm water drop inlets clear. There is often a significant amount of debris that runs off of a fresh construction site during a rain event toward the storm water drop inlets. Even a single grocery bag or clump of leaves may clog a storm drain grate and begin the negative effects of flooding.

During high flow events, a vortex forms naturally over storm drain grates. However, when a board, grocery bag, or other obstructive debris enters the flow, the vortex may be interrupted such that the debris in the water column surrounding that vortex gets sucked into the storm drain grate and causing it to clog. Once the vortex is interrupted by larger debris and the storm drain grate clogs, flooding often begins, which can then cause significant economic damage downslope on commercial and residential development construction projects and/or onto other private or public properties downslope.

Accordingly, a need exists for apparatuses and methods to safeguard the drainage flow of storm drain grates.

SUMMARY

In one embodiment, an apparatus may include an annular apex support member and an apex member affixed to the apex support member. The apparatus may also include an annular intermediate support member having a circumference larger than the apex support member. The apparatus may further include a first portion forming a conical frustum between the apex support member and the intermediate support. The apparatus may additionally include an annular base support member having a circumference equal to or larger than the intermediate support. The apparatus may still further include a second portion between the intermediate support member and the base support member. The apparatus may also further include at least three vertical members each peripherally connected to the apex support member, the first portion, the intermediate support member, the second portion, and base support member such that the vertical members surround a longitudinal axis. With respect to the apparatus, a subset of at least two of the vertical members each has a protruding portion that protrudes orthogonally from the base support member in a direction opposite the apex support member.

In another embodiment, a method for installing the preceding apparatus may include covering the storm drain grate with fabric. The method may also include cutting a circular hole in the fabric for the placement of the apparatus, with the hole and base support member having approximately equal diameters. The method may further include aligning the apparatus such that each protruding member enters an opening in the storm drain grate. The method may still further include securing each protruding member to the storm drain gate.

In yet another embodiment, an apparatus may include an annular apex support member and a handle affixed to the apex support member. The apparatus may also include an annular intermediate support member having a circumference larger than the apex support member. The apparatus may also include a first portion forming a conical frustum between the apex support member and the intermediate support. The apparatus may additionally include an annular base support member having a circumference equal to or larger than the intermediate support. The apparatus may further include a second portion between the intermediate support member and the base support member. The apparatus may still also include at least three vertical members each peripherally connected to the apex support member, the first portion, the intermediate support member, the second portion, and base support member such that the vertical members surround a longitudinal axis. The apparatus may still further include a subset of at least two of the vertical members each has a protruding portion that protrudes orthogonally from the base support member in a direction opposite the apex support member. Additionally, the apex support member, first portion, intermediate support member, second portion, base support member, and vertical members are circumferentially oriented about the longitudinal axis.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to apparatuses and methods for guarding the flow of liquids into storm grates. For a given storm grate, a vortex typically forms during periods of heavy deluge as liquid swirls into the grate. However, debris being carried within the deluge can interrupt the vortex, and thus the ability of the liquid to properly drain into the storm grate. Using liquid-proof barriers around a storm grate, while preventing debris from entering the storm gate, would also prevent liquid from entering the storm grate, thus defeating the purpose of having the storm grate for drainage. Moreover, a liquid-permeable barrier, such as stones around a storm grate, is often impractical as the stones can be moved by a deluge, which would allow the stones and/or debris to cover the storm grate. Utilizing a liquid-permeable, debris-impermeable apparatus that is secured to the storm grate provides both stability and reliable drainage, whether from a deluge or just a trickle of liquid.

Figure 1:
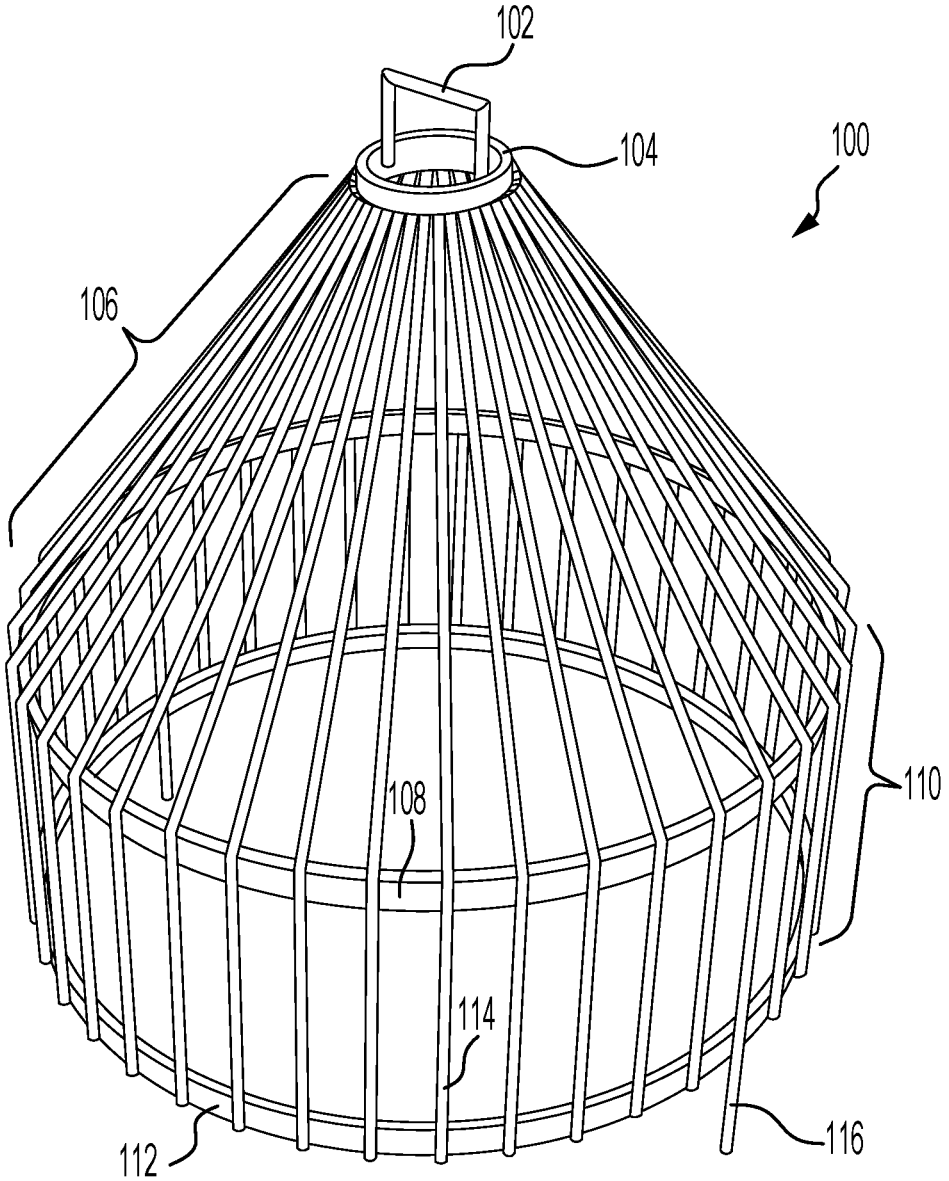
FIG. 1 illustrates a perspective view of an exemplary grate guard apparatus, according to one or more embodiments shown and described herein.

Referring now to FIG. 1, a perspective view of an exemplary grate guard apparatus is shown according to various embodiments. A grate guard 100 may have an apex support member 104 to which an apex member 102 may be fastened or otherwise affixed. An apex support member 104 may be annular or have any other suitable shape, and may be of any suitable thickness, height, and/or length. Although depicted as a raised handle, the apex member 102 may utilize any suitable shape/material/configuration such as a flat bar, a curved bar, a rope, and the like.

Vertical members 114 may extend from the apex support member 104 to an intermediate support member 108. In this embodiment, the intermediate support member 108 is larger than the apex support member 104. The vertical members 114 enclose a first portion 106 having a conical frustum shape. Any number of vertical members 114 may be utilized, such that the more vertical members that are utilized, the smaller each opening between them is, and thus the more debris is excluded from entering the first portion 106. In this embodiment, each vertical member 114 extends from the apex support member 104 to the closest location on the intermediate support member 108. The intermediate support member 108 may be annular or have any other suitable shape, and may be of any suitable thickness, height, and/or length.

In this embodiment, the vertical members 114 may extend vertically downward from the intermediate support member 108 to a base support member 112 both having the same circumference, thus enclosing a cylindrical second portion 110 directly beneath the first portion 106. In this embodiment, there is no barrier between the first portion 106 and the second portion 110, although one or more barriers may be utilized in other embodiments. In other embodiments, the second portion 110 may be any other suitable shape. In this embodiment, the vertical members 114 extend from the apex support member 104, to the intermediate support member 108, and continue downward to the base support member 112. In other embodiments, the vertical members 114 need not be continuous, such as having a break in continuity at the intermediate support member 108. In some embodiments, the orientation, quantity, thickness, shape of any vertical member 114 below the intermediate support member 108 need not correspond to a vertical member 114 above it. Moreover, any vertical member 114 may differ from any other vertical member 114 anywhere else on the grate guard 100. In this embodiment, the intermediate support member 108 and/or base support member 112 may be utilized to reinforce the strength, shape, and/or integrity of the grate guard 100 against high-speed impacts and/or pressure from deluges and the debris hurtled at the grate guard 100.

In this embodiment, one or more vertical members 114 may extend beyond the base support member 112 to form one or more protruding members 116. Protruding members 116 may directly extend from above the base support member 112 to below it. In other embodiments, the vertical members 114 need not be continuous, such as having a break in continuity at the base support member 112. In some embodiments, the orientation, quantity, thickness, shape of any protruding member 116 below the base support member 112 need not correspond to a vertical member 114 above it. Any suitable number and/or configuration of protruding members 116 may be utilized.

In some embodiments, the apex support member 104, intermediate support member 108, and/or base support member 112 may not wrap completely around the grate guard 100. Any portion of the grate guard 100 may be made of one or more materials such as aluminum, steel, iron, plastic, wood, and/or any other suitable material. Some embodiments may not utilize one or more of an apex member 102, an apex support member 104, a first portion 106, an intermediate support member 108, a second portion 110, a base support member 112, a vertical member 114, and a protruding member 116. Although depicted as round/conical/cylindrical in various components, the grate guard 100 and/or its constituent components may utilize any suitable shape. Any of the grate guard 100 components may be welded, fastened (via screws, bolts, glue, magnets, and the like), or otherwise secured together in any fashion that maintains the cohesiveness of the grate guard 100. The components such as the apex member 102, apex support member 104, intermediate support member 108, base support member 112, vertical members 114, and protruding members 116 are depicted as being symmetrically located along a longitudinal axis extending from the apex member 102 to the down through the center of the base support member 112. This may include uniform spacing of the vertical members 114 about the longitudinal axis. In some embodiments, components of the grate guard 100 need not be oriented in this manner.

Figure 2A:
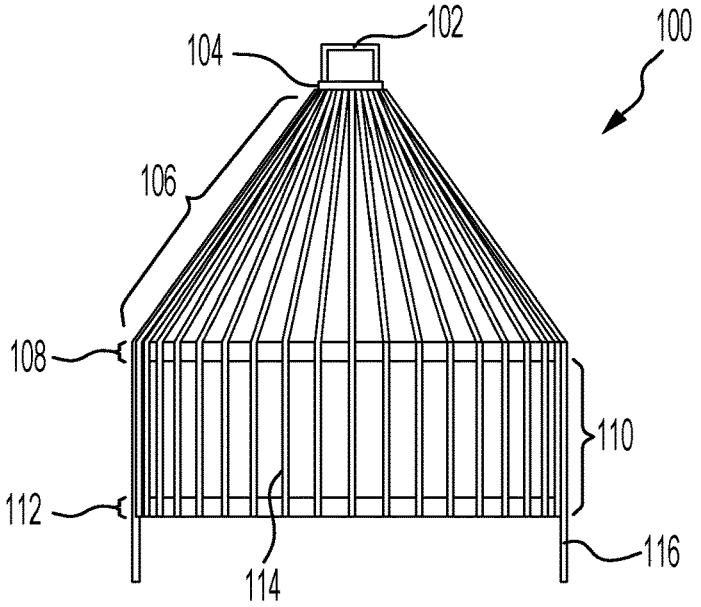
FIG. 2A illustrates a side view of an exemplary grate guard apparatus, according to one or more embodiments shown and described herein.

Referring now to FIG. 2A, a side view of an exemplary grate guard apparatus is shown according to various embodiments.

Figure 2B:
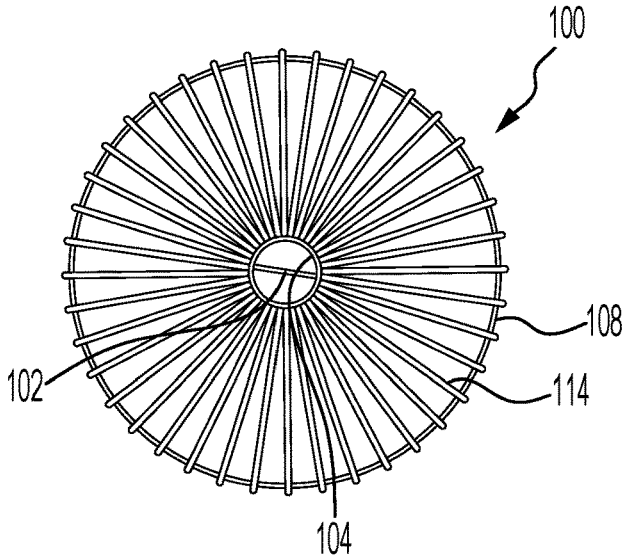
FIG. 2B illustrates a top view of an exemplary grate guard apparatus, according to one or more embodiments shown and described herein.

Referring now to FIG. 2B, a top view of an exemplary grate guard apparatus is shown according to various embodiments.

Figure 2C:
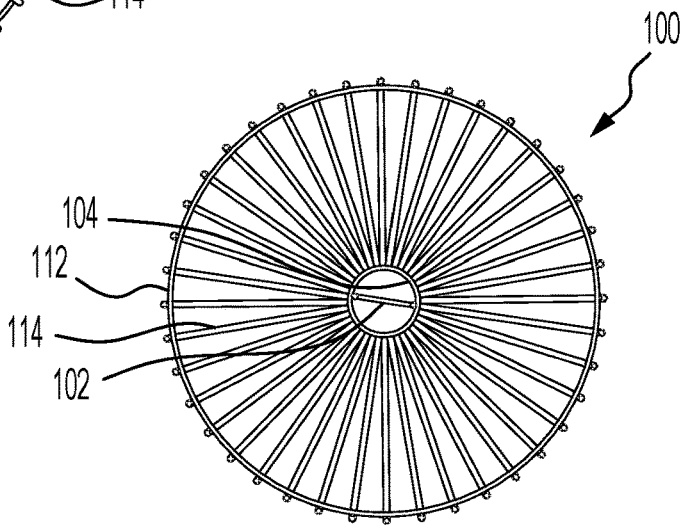
FIG. 2C illustrates a bottom view of an exemplary grate guard apparatus, according to one or more embodiments shown and described herein.

Referring now to FIG. 2C, a bottom view of an exemplary grate guard apparatus is shown according to various embodiments.

Figure 3A:
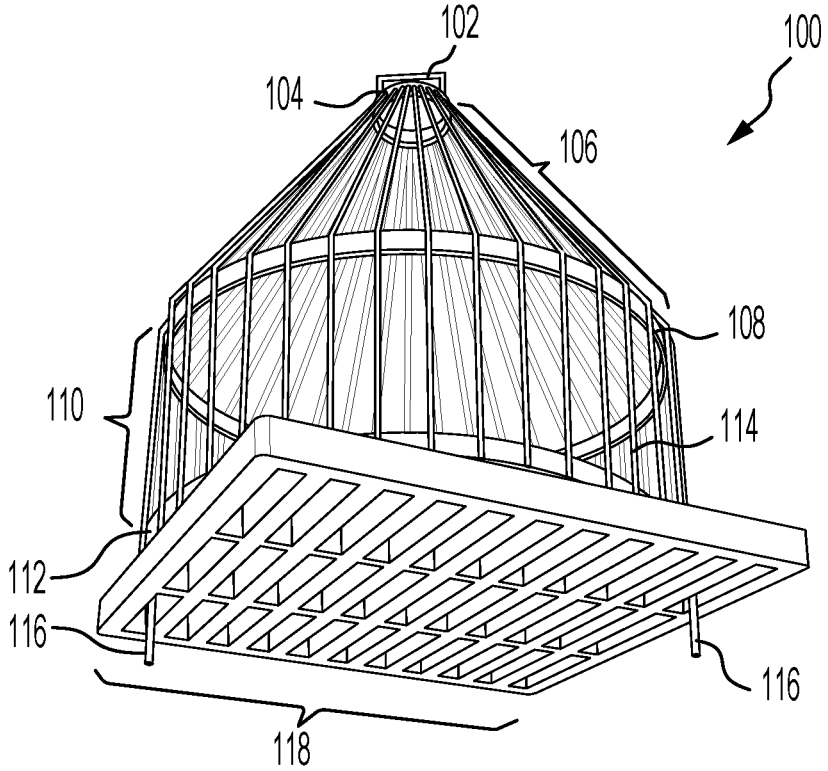
FIG. 3A illustrates an upward perspective view of an exemplary grate guard apparatus atop a grate having a grid of elongated openings, according to one or more embodiments shown and described herein.

Referring now to FIG. 3A, an upward perspective view of an exemplary grate guard apparatus atop a grate having a grid of elongated openings is shown according to various embodiments. The longitudinal axis of the grate guard 100 as depicted here is orthogonal to the grate 118. As depicted, the grate guard 100 has two protruding members 116 protruding through openings in the grate. In this embodiment, the protruding members 116 are located on opposite sides of the base support member 112, although protruding members 116 may be placed in suitable locations along the base support member 112. Any suitable means/mechanism may be utilized to removably secure the protruding members 116 to the grate 118, such as tying, adhesives, and the like. In some embodiments, the protruding members 116 and/or base support member 112 may be permanently affixed to the grate (welding and the like). In some embodiments, protruding members 116 may not be secured/affixed to the grate 118.

Figure 3B:
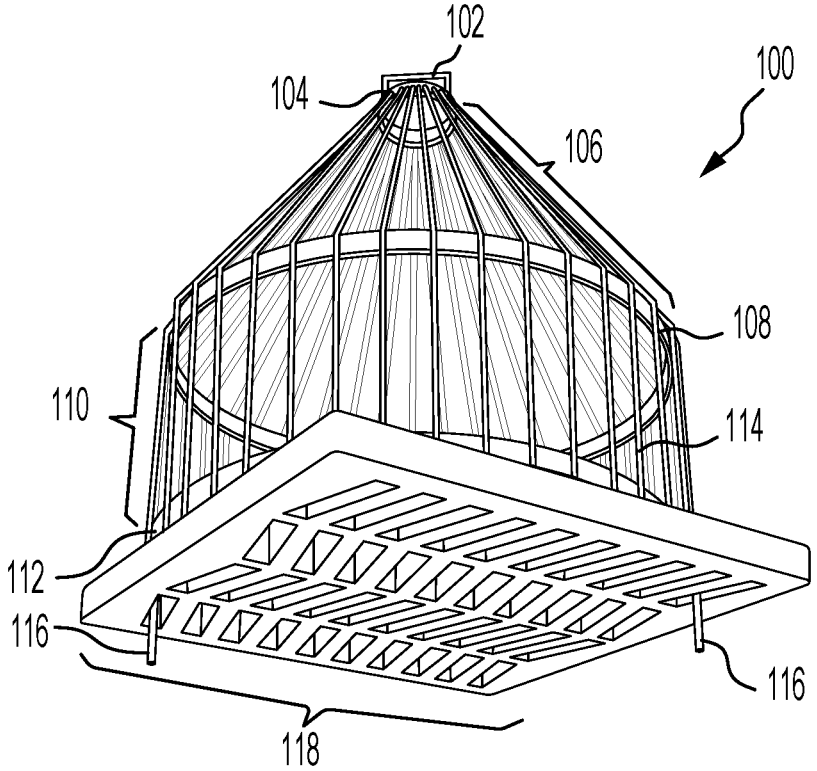
FIG. 3B illustrates an upward perspective view of an exemplary grate guard apparatus atop a grate having elevated ridges with elongated openings, according to one or more embodiments shown and described herein.

Referring now to FIG. 3B, an upward perspective view of an exemplary grate guard apparatus atop a grate having elevated ridges with elongated openings is shown according to various embodiments.

Figure 3C:
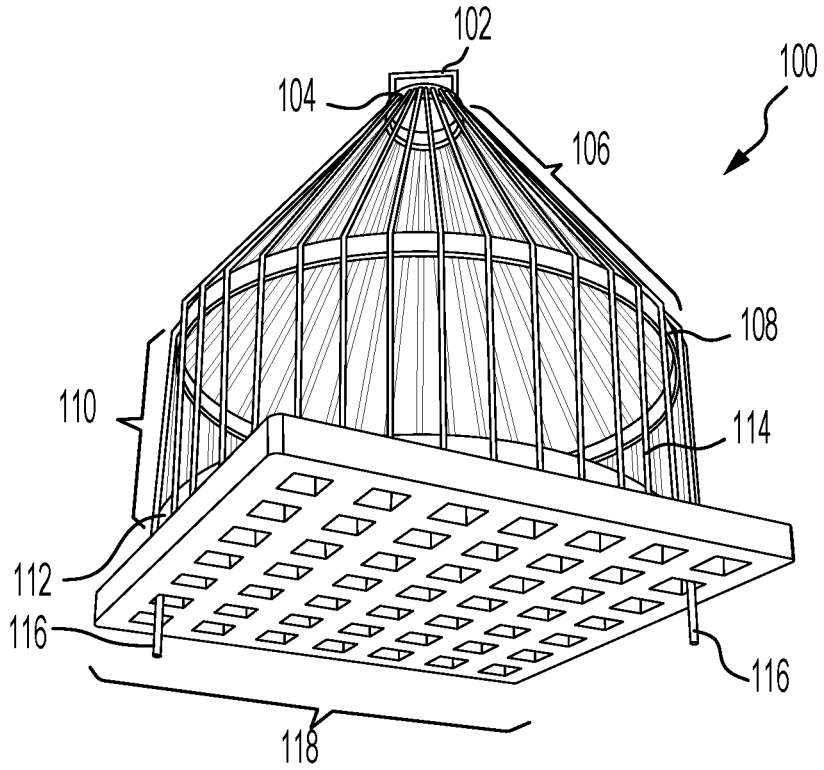
FIG. 3C illustrates an upward perspective view of an exemplary grate guard apparatus atop a grate having a grid of square openings, according to one or more embodiments shown and described herein.

Referring now to FIG. 3C, an upward perspective view of an exemplary grate guard apparatus atop a grate having a grid of square openings is shown according to various embodiments.

Figure 3D:
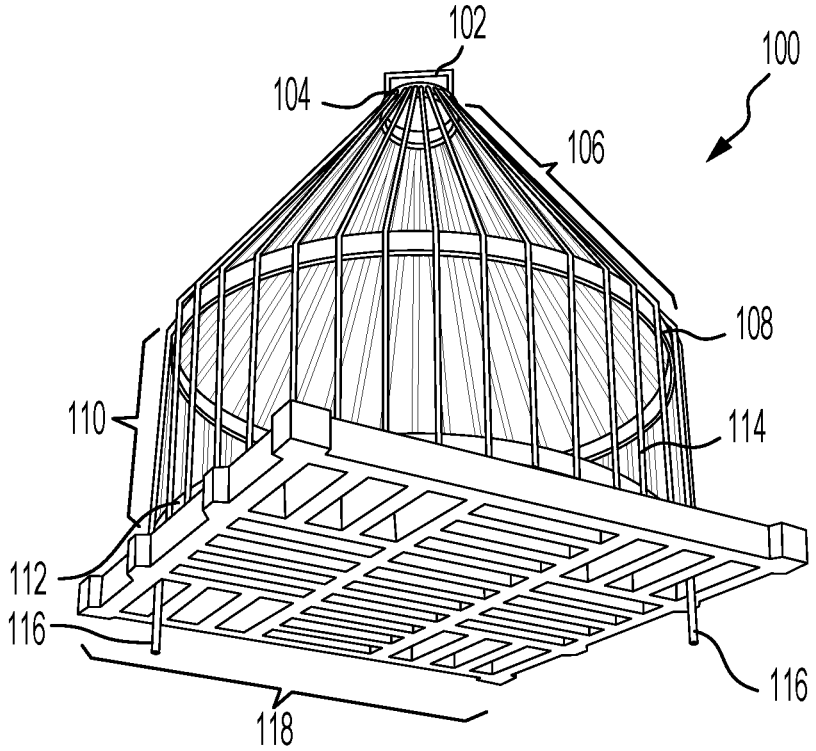
FIG. 3D illustrates an upward perspective view of an exemplary grate guard apparatus atop a grate having a grid of parallel and orthogonal elongated openings, according to one or more embodiments shown and described herein.

Referring now to FIG. 3D, an upward perspective view of an exemplary grate guard apparatus atop a grate having a grid of parallel and orthogonal elongated openings is shown according to various embodiments.

Figure 4A:
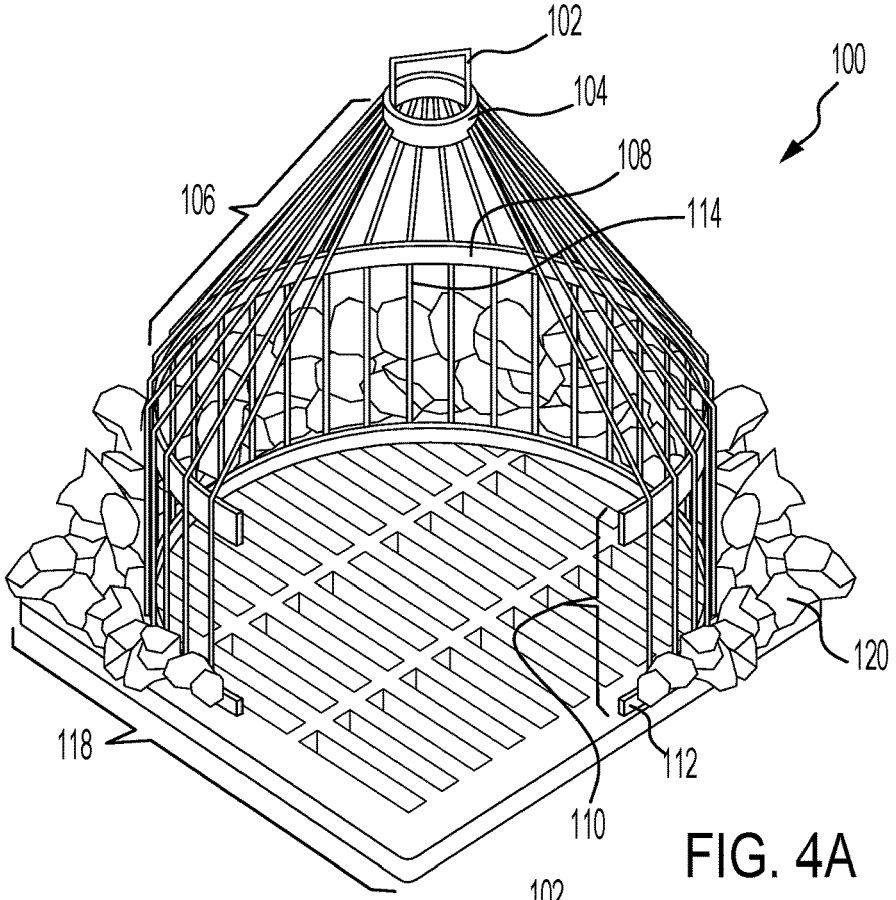
FIG. 4A illustrates a cut-away view of an exemplary grate guard apparatus secured atop a grate and surrounded by stones, according to one or more embodiments shown and described herein.

Referring now to FIG. 4A, a cut-away view of an exemplary grate guard apparatus secured atop a grate and surrounded by stones is shown according to various embodiments. A ring of stones 120 around the outside of the grate guard 100 may be used to form a reverse sediment trap for erosion and sediment control purposes. Additionally, the flow of liquid into the grate guard 100 for drainage into the grate 118 is preserved.

Figure 4B:
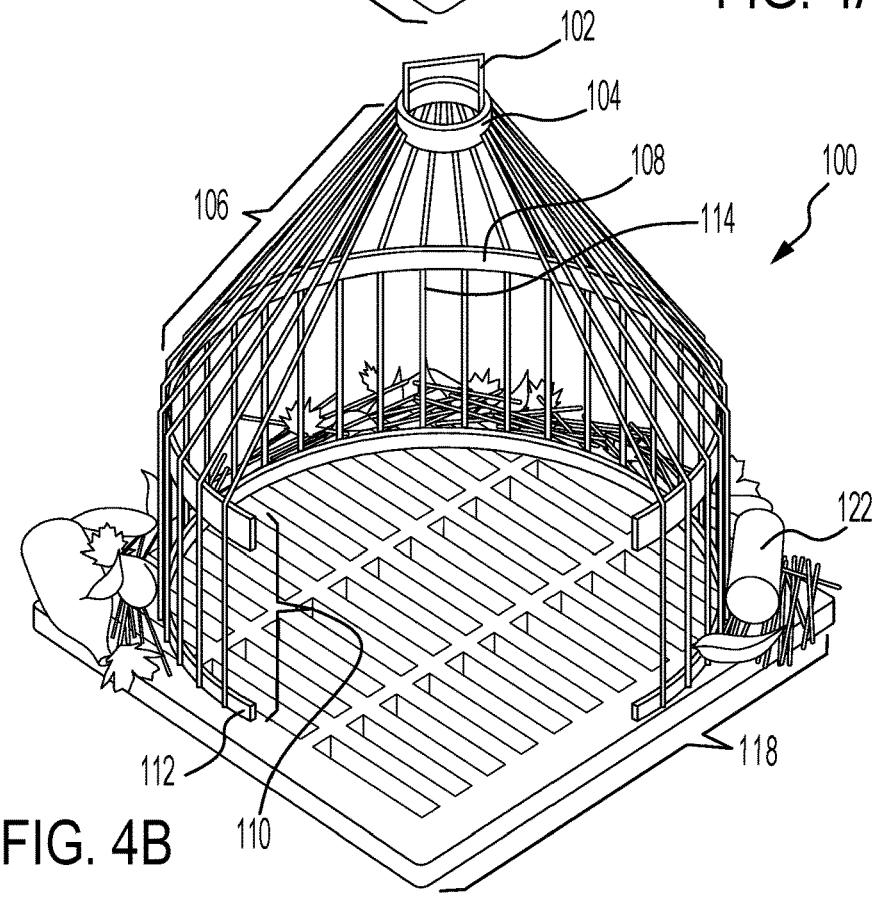
FIG. 4B illustrates a cut-away view of an exemplary grate guard apparatus secured atop a grate and surrounded by debris, according to one or more embodiments shown and described herein.

Referring now to FIG. 4B, a cut-away view of an exemplary grate guard apparatus secured atop a grate and surrounded by debris is shown according to various embodiments. Various types of debris 122 may be washed up by liquid entering the grate guard 100. Although the debris 122 depicted includes sticks and bottles, any other type of debris capable of being carried by a deluge may be encountered. The corners of the grate 118 are located outside of the grate guard 100 and are covered in debris 122, such that drainage on these portions of the grate 118 are inhibited. By contrast, the circular portion of the grate 118 covered by the grate guard 100 experiences unobstructed drainage of liquid entering the grate guard 100.

Figure 5:
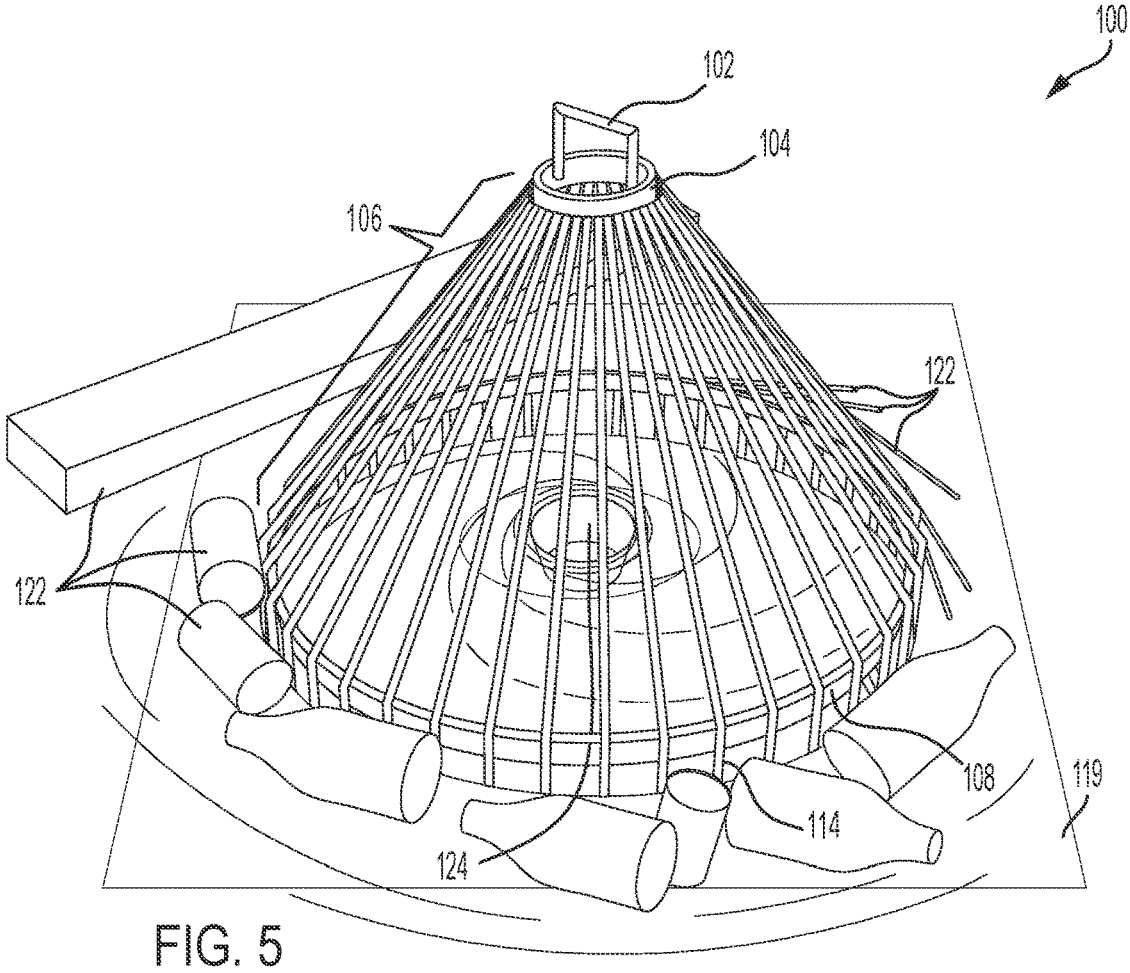
FIG. 5 illustrates a perspective view of an exemplary grate guard apparatus partially-submerged in liquid with a vortex inside and debris outside, according to one or more embodiments shown and described herein.

Referring now to FIG. 5, a perspective view of an exemplary grate guard apparatus partially-submerged in liquid with a vortex inside and debris outside is shown according to various embodiments. Any of the larger objects of debris 122, in the absence of the grate guard 100, would drift to be atop the vortex 124 that has occurred above a grate (not shown), which would disrupt the vortex and thus the impede drainage into the grate. The grate guard 100 protects the vortex 124 from various debris 122 that is drawn towards the vortex 124 by virtue of its suction and rotation. This may include where the ground adjacently surrounding the grate 118 is sloped.

In one embodiment, installing a grate guard 100 on a grate 118 includes covering the grate 118 with fabric 119. Any suitable type of fabric 119, such as landscaping fabric, or any other type of filter fabric, may be utilized. A circular hole in the fabric 119 may then be cut for the placement of the grate guard 100, with the hole and base support member 112 having approximately equal diameters, although differing diameters may be utilized in other embodiments. The grate guard 100 may then be aligned such that each protruding member 116 enters an opening in the grate 118. Each protruding member 116 can then be secured to the grate 118. Stones 120 may be placed around the grate guard 100 to form a reverse sediment trap on top of the grate 118.

Figure 6:
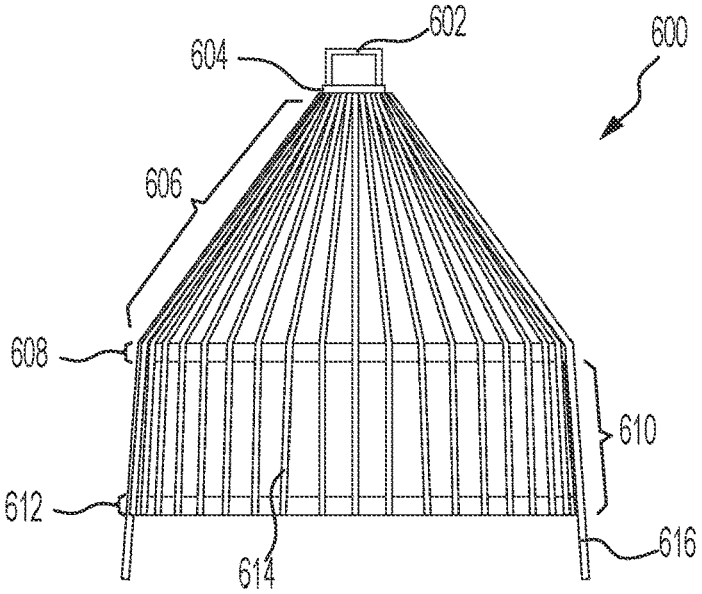
FIG. 6 illustrates a perspective view of another embodiment of a grate guard apparatus having an intermediate support member smaller than a base support member, according to one or more embodiments shown and described herein.

Referring now to FIG. 6, a perspective view of a grate guard apparatus having an intermediate support member smaller than a base support member is shown according to various embodiments. A grate guard 600 may have an apex support member 604 to which an apex member 602 may be fastened or otherwise affixed. Thus, the circumference of the base support member 612 exceeds the circumference of the intermediate support member 608. In this embodiment, the second portion 610 is a conical frustum having a steeper slope than the first portion 606. One or more vertical members 614 may extend beyond the base support member 612 to form one or more protruding members 616.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

It is noted that the terms "substantially" and "about" and "approximately" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The inventor would like to acknowledge his wife, Alyssa Hodge. Although not an inventor of the subject matter of this application, she created the CAD figures that served as a basis of many of the figures herein. Alyssa has a degree in drafting/design engineer technology and is a CAD technician at Cheat Road Engineering, Inc.

What is claimed is:

1. An apparatus comprising:

an annular apex support member;

an apex member affixed to the apex support member;

an annular intermediate support member having a circumference larger than the apex support member;

a first portion forming a conical frustum between the apex support member and the intermediate support;

an annular base support member having a circumference equal to or larger than the intermediate support;

a second portion between the intermediate support member and the base support member; and at least three vertical members each peripherally connected to the apex support member, the first portion, the intermediate support member, the second portion, and base support member such that the vertical members surround a longitudinal axis, wherein a subset of at least two of the vertical members each has a protruding portion that protrudes orthogonally from the base support member in a direction opposite the apex support member, wherein a method of installing the apparatus on a storm drain grate comprises:

covering the storm drain grate with fabric;

cutting a circular hole in the fabric for the placement of the apparatus, with the hole and base support member having approximately equal diameters;

aligning the apparatus such that each protruding member enters an opening in the storm drain grate; and securing each protruding member to the storm drain gate.

2. The method of claim 1 wherein the fabric is a landscaping fabric or other type of filter fabric.

3. The method of claim 1 further comprising:

placing stones outside against the apparatus to form a reverse sediment trap on top of the storm drain grate.

* * * * *